US011707814B2

(12) United States Patent
Naderer

(10) Patent No.: US 11,707,814 B2
(45) **Date of Patent: *Jul. 25, 2023**

(54) GRINDING MACHINE FOR ROBOT-SUPPORTED GRINDING

(71) Applicant: FerRobotics Compliant Robot Technology GmbH, Linz (AT)

(72) Inventor: Ronald Naderer, Oberneukirchen (AT)

(73) Assignee: FerRobotics Compliant Robot Technology GmbH, Linz (AT)

( * ) Notice: Subject to any disclaimer, the term of this patent is extended or adjusted under 35 U.S.C. 154(b) by 735 days.

This patent is subject to a terminal disclaimer.

(21) Appl. No.: 16/606,677

(22) PCT Filed: Apr. 19, 2018

(86) PCT No.: PCT/EP2018/060054

§ 371 (c)(1),
(2) Date: Oct. 18, 2019

(87) PCT Pub. No.: WO2018/193040

PCT Pub. Date: Oct. 25, 2018

(65) Prior Publication Data

US 2021/0362292 A1 Nov. 25, 2021

(30) Foreign Application Priority Data

Apr. 20, 2017 (DE) ..... 102017108426.6

(51) Int. Cl.
*B25J 11/00* (2006.01)
*B24B 55/06* (2006.01)
(Continued)

(52) U.S. Cl.
CPC ..... *B24B 41/007* (2013.01); *B24B 27/0038* (2013.01); *B24D 9/08* (2013.01)

(58) Field of Classification Search
None
See application file for complete search history.

(56) References Cited

U.S. PATENT DOCUMENTS 3,585,980 A * 6/1971 Mellor ..... B24B 55/102 451/41
3,824,745 A 7/1974 Hutchins
(Continued)

FOREIGN PATENT DOCUMENTS

CN 102123826 A 7/2011
CN 202174475 U 3/2012
(Continued)

*Primary Examiner* — Monica S Carter
*Assistant Examiner* — Dana Lee Poon
(74) *Attorney, Agent, or Firm* — Murphy, Bilak & Homiller, PLLC

(57) ABSTRACT

The invention relates to a grinding machine, which is suitable for a robot-supported grinding process. According to one embodiment, the grinding machine has a housing, a motor arranged in the interior of the housing, a fan wheel arranged on a motor shaft of the motor in the interior of the housing, and a support plate coupled to the motor shaft for receiving a grinding disc. The support plate has openings for intake of grinding dust into the interior of the housing. The grinding machine furthermore has an outlet arranged in a wall of the housing for exhausting the grinding dust out of the interior of the housing and a non-rerun valve arranged in the wall of the housing. The non-return valve enables an to escape from the interior of the housing, but prevents intake of air into the interior of the housing.

17 Claims, 3 Drawing Sheets

(51) Int. Cl.

| | |
|---|---|
| ***B25J 9/12*** | (2006.01) |
| ***B24B 41/00*** | (2006.01) |
| ***B24B 27/00*** | (2006.01) |
| ***B24D 9/08*** | (2006.01) |

(56) References Cited

U.S. PATENT DOCUMENTS

| | | | | |
|---|---|---|---|---|
| 5,170,588 | A | 12/1992 | Schaal et al. | |
| 5,231,803 | A * | 8/1993 | Lanzer | B24D 9/085 451/28 |
| 6,047,693 | A | 4/2000 | Yamami et al. | |
| 6,057,693 | A * | 5/2000 | Murphy | G01N 33/2852 324/672 |
| 6,969,310 | B1 * | 11/2005 | Ghilardi | B24B 23/00 451/75 |
| 7,118,452 | B2 * | 10/2006 | Wood | B24B 27/0038 451/158 |
| 2004/0259471 | A1 * | 12/2004 | Antenen | B25J 15/0019 451/5 |
| 2005/0277373 | A1 | 12/2005 | Ghilardi | |
| 2013/0244551 | A1 * | 9/2013 | Liu | B25J 15/0019 451/340 |
| 2015/0020369 | A1 * | 1/2015 | Ryan | B25B 11/02 451/527 |
| 2015/0328734 | A1 * | 11/2015 | Multhammer | B23Q 3/15706 483/33 |
| 2020/0078940 | A1 * | 3/2020 | Evers | B25J 13/085 |

FOREIGN PATENT DOCUMENTS

| | | | |
|---|---|---|---|
| CN | 103802088 | A | 5/2014 |
| CN | 103386642 | B | 9/2015 |
| CN | 105109245 | A | 12/2015 |
| CN | 106181899 | A | 12/2016 |
| DE | 10053582 | A1 | 5/2002 |
| DE | 102005036195 | A1 | 2/2007 |
| DE | 102012211635 | A1 | 1/2014 |
| EP | 0252552 | A1 | 1/1988 |
| GB | 2343393 | A | 5/2000 |
| JP | S61159366 | A | 7/1986 |
| JP | H0947382 | A | 2/1997 |
| JP | 2003039299 | A | 2/2003 |
| JP | 2003053654 | A | 2/2003 |
| JP | 2003145404 | A | 5/2003 |
| JP | 2011041992 | A | 3/2011 |
| JP | 2011098422 | A | 5/2011 |
| JP | 2019130645 | A | 8/2019 |
| WO | 2016145472 | A1 | 9/2016 |

* cited by examiner

GRINDING MACHINE FOR ROBOT-SUPPORTED GRINDING

TECHNICAL FIELD

The present disclosure relates to a grinding machine for robot-supported grinding, in particular to a compact, light grinding machine for mounting onto a manipulator.

BACKGROUND

In robot-supported grinding apparatuses a grinding tool (e.g. an electrically driven grinding machine with a rotating grinding disc) is guided by a manipulator, for example, by an industrial robot. In this process, the grinding tool can be coupled to the TCP (Tool Center Point) of the manipulator in various ways, enabling the manipulator to adjust the tool to virtually any position and orientation. Industrial robots are generally position-adjusted, which allows for a precise movement of the TCP along the desired trajectory. In order to achieve good results from the robot-supported grinding, many applications require that the processing force (grinding force) be regulated, which is difficult to carry out with sufficient accuracy using conventional industrial robots. The large, heavy arm segments of an industrial robot possess too much inertia for a controller (closed-loop controller) to be able to react quickly enough to variations in the processing force. To solve this problem, a linear actuator that is smaller than the industrial robot and that couples the TCP of the manipulator to the grinding tool can be arranged between the TCP of the manipulator and the grinding tool. The linear actuator only regulates the processing force during grinding (that is, the contact force between the tool and the workpiece), while the manipulator moves the grinding tool together with the linear actuator in a position-controlled manner along a specifiable trajectory.

Conventional orbital or eccentric action grinding machines are comparably inefficient as they are designed to be used for manual work. The robot can operate more quickly and can apply more force, which requires more grinding power. The small and compact construction design of orbital or eccentric action grinding machines can also cause heat-related problems. Furthermore, flexural forces of hoses and cables can produce disturbing forces that alter the processing force during grinding and which, nevertheless, cannot be eliminated by the controller.

The inventors have set themselves the objective of developing a compact grinding machine that is suitable for robot-supported grinding and that allows for a comparably precise adjustment of the processing force during grinding.

SUMMARY

A grinding machine is described which is suitable for a robot-supported grinding process. In accordance with one embodiment, the grinding machine comprises a housing, a motor arranged in the interior of the housing, a fan wheel arranged on a motor shaft of the motor in the interior of the housing and a backing pad coupled to the motor shaft for receiving a grinding disc. The backing pad has openings for suctioning grinding dust into the interior of the housing. The grinding machine further comprises an outlet arranged in a wall of the housing for discharging the grinding dust out of the interior of the housing and a check valve arranged in the wall of the housing. The check valve allows air to escape from the interior of the housing, prevents, however, air from being suctioned into the interior of the housing.

Further, an apparatus for robot-supported grinding is described. In accordance with one embodiment, the apparatus comprises a manipulator, a grinding machine, a linear actuator that couples the grinding machine to a TCP of the manipulator, and a extraction system connected to an outlet in the housing of the grinding machine.

Finally, a method for cooling a grinding machine that has a rotatable backing pad for receiving a grinding disc is described. In accordance with one embodiment, the method comprises creating a vacuum in the interior of the housing of the grinding machine using a extraction system that is connected to the interior of the housing via an air outlet in a wall of the housing. The vacuum causes an air stream to flow through the openings in the backing pad that suctions grinding dust into the interior of the housing. The dust is then discharged over the outlet in the wall of the housing. At the same time, the air stream also cools a motor arranged in the interior of the housing. For cases in which the extraction system is inactive, the method comprises creating an additional air stream to cool the motor through the openings in the backing pad employing a fan wheel, thereby creating a stagnation pressure in the interior of the housing which causes a check valve arranged in the wall of the housing to open so the additional air stream can flow out.

SHORT DESCRIPTION OF THE FIGURES

Various embodiments will now be described in greater detail by means of the examples illustrated in the figures. The illustrations are not necessarily true to scale and the embodiments are not to be limited to the aspects illustrated here. Instead importance is given to illustrating the basic principles underlying the embodiments. In the figures, like reference signs designate corresponding parts. The figures show:

Figure 5A:
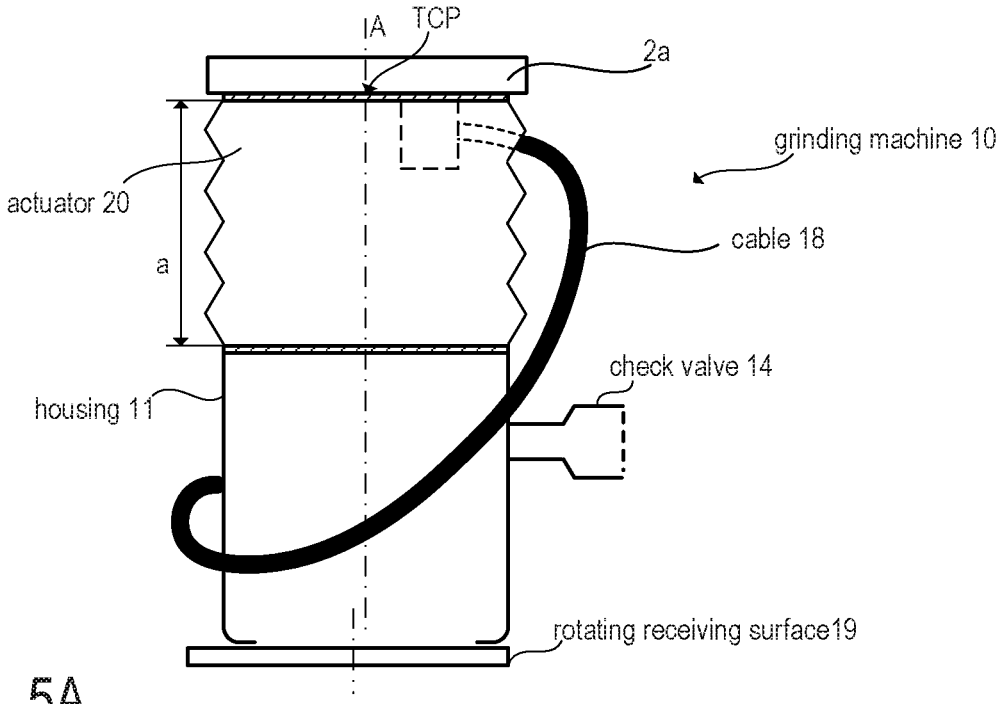
Figure 5B:
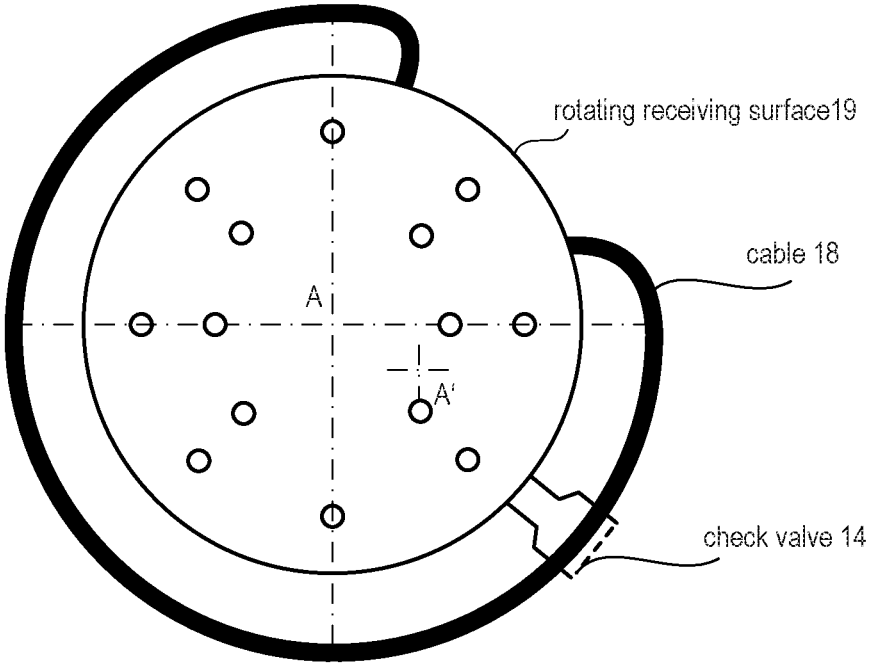

FIGS. 5A and 5B, together FIG. 5, show an example cable routing on a robot-supported grinding device.

DETAILED DESCRIPTION

Before describing various embodiments in detail, an example of a robot-supported grinding apparatus will be described. This comprises a manipulator 1, for example, an industrial robot, and a grinding machine 10 with a rotating grinding tool (e.g. an orbital grinding machine), wherein the tool is coupled to the so-called tool center point (TCP) of the manipulator 1 via a linear actuator 20. In the case of an industrial robot that possesses six degrees of freedom, the manipulator can be constructed of four segments 2*a*, 2*b*, 2*c* and 2*d*, each of which is connected via the joints 3*a*, 3*b* and 3*c*. The first segment is usually rigidly connected to a base 41 (which, however, need not necessarily be the case). The joint 3*c* connects the segments 2*c* and 2*d*. The joint 3*c* may be biaxial, allowing for a rotation of segment 2*c* around a horizontal axis of rotation (elevation angle) and a vertical axis of rotation (azimuth angle). The joint 3*b* connect the segments 2*b* and 2*c* and allows the segment 2*b* to carry out a swivel movement relative to the position of the segment 2*c*. The joint 3*a* connects the segments 2*a* and 2. The joint 3*a* may be biaxial, thereby (as in the case of joint 3*c*) allowing for a swivel movement in two directions. The TCP is at a fixed position relative to segment 2*a*, whereas the latter generally also has a rotating joint (not shown) that allows the segment 2*a* to rotate around a longitudinal axis A (in FIG. 1 this is designated by a dot dashed line and corresponds to the axel of rotation of the grinding tool). Every axis of a joint is provided with an actuator that can effect a rotational movement around the respective joint axis. The actuators in the joints are controlled by a robot controller 4 in accordance with a robot program.

Figure 1:
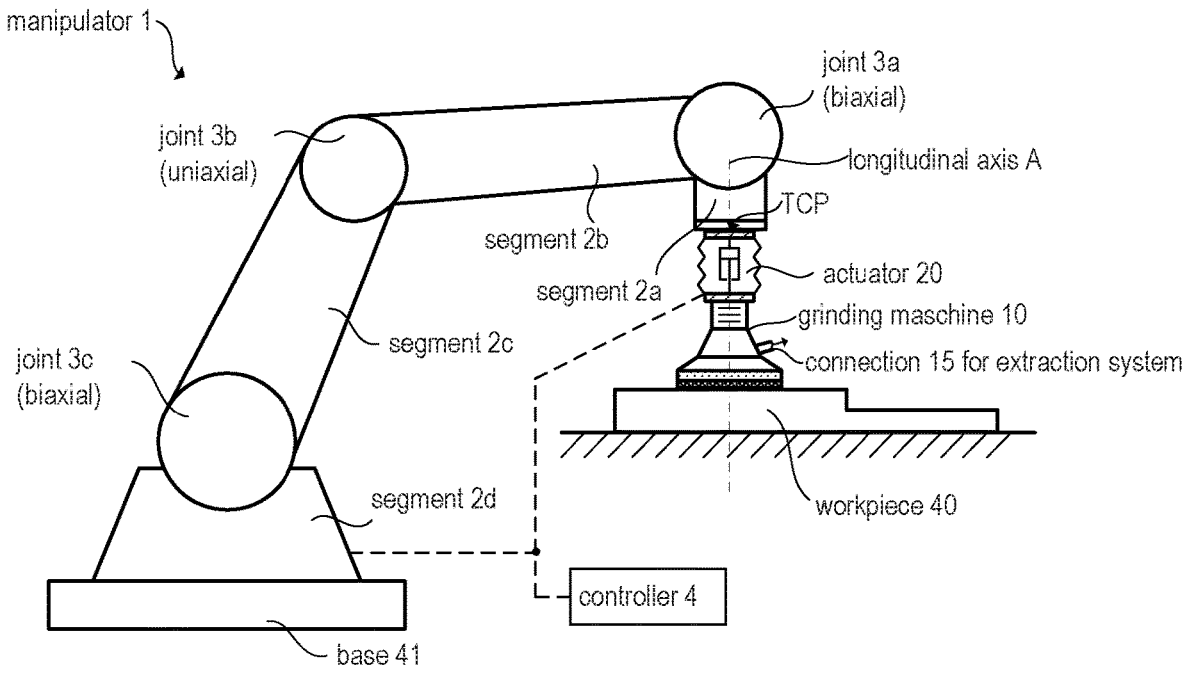
FIG. 1 shows schematically an example of a robot-supported grinding apparatus.

The manipulator 1 is generally position-adjusted, i.e. the robot controller can determine the pose (position and orientation) of the TCP and can move it along a previously defined trajectory. In FIG. 1, the longitudinal axis of the segment 2*a* on which the TCP lies is designated as A. When the actuator 20 rests against an end stop, the pose of the TCP also defines the pose of the grinding tool. As mentioned at the beginning, the actuator 20 serves to adjust the contact force (processing force) between tool (grinding machine 10) and workpiece 40 to a desired value during the grinding process. Using the manipulator 1 to directly adjust the force is generally too imprecise for grinding applications, as it is virtually impossible for conventional manipulators to quickly compensate for peaks in the force (that occur, i.e. when the grinding tool is placed on the workpiece 40) due to the high inertia of the manipulator's 1 segments 2*a*-*c*. For this reason, the robot controller is configured to adjust the pose of the manipulator's TCP, whereas the force is exclusively adjusted by the actuator 20.

As previously mentioned, the contact force $F_K$ (also called processing force) between tool (grinding machine 10) and workpiece 40 can be adjusted using the (linear) actuator 20 and a force controller (which, for example, can be implemented in the controller 4) to correspond to a specifiable desired value. This contact force is a reaction to the actuator force with which the linear actuator 20 presses against the workpiece surface. If no contact between the workpiece 40 and the tool takes place, the actuator 20, because of the absence of contact force on the workpiece 40, comes to rest against an end stop (not shown here as it is integrated in the actuator 20). Position adjustment of the manipulator 1 (which can also be implemented in the controller 4) can be carried out completely independently of the force adjustment of the actuator 20. The actuator 20 is not responsible for positioning the grinding machine 10, but only for adjusting and maintaining the desired contact force during the grinding process and for recognizing when contact between tool and workpiece takes place.

The actuator may be a pneumatic actuator, i.e. a double-acting pneumatic cylinder. However, other pneumatic actuators such as, e.g. bellow cylinders and air muscles may also be used. Alternatively, (gearless) direct electric drives may also be considered. Here it should be pointed out that the effective direction of the actuator 20 need not necessarily follow along the longitudinal axis A of segment 2*a* of the manipulator. In the case of a pneumatic actuator, adjusting the force can be carried out with a control valve or a controller (implemented in the controller 4) and a compressed air tank using commonly known methods. The precise manner of this implementation, however, is of no importance for the further description and need not be explained here in detail. Grinding machines generally possess an extraction system for vacuuming up grinding dust. A connection 15 for a hose of an extraction system is shown in FIG. 1. This extraction system will be explained further below in greater detail.

As mentioned earlier, the inertia of the grinding machine may be an issue with regard to a precise adjustment of the contact force (processing force). Designing the grinding machine to be smaller and more compact, however, results in increased power densities, which in turn results in increased heat dissipation (and correspondingly high temperatures) in comparatively small spaces. In the case of an orbital grinding machine, the excess heat partially arises, on the one hand, in the electromotor of the grinding machine (e.g. ohmic losses, iron losses, friction losses in the bearings) and, on the other hand, in the eccentric bearings that allow for the orbital movement. In the examples shown here, a compact construction design is achieved, inter alia, by combing the cooling and extraction systems. This means, when in "normal" operation, the air stream generated by the grinding dust extraction system is also used for cooling.

Figure 2:
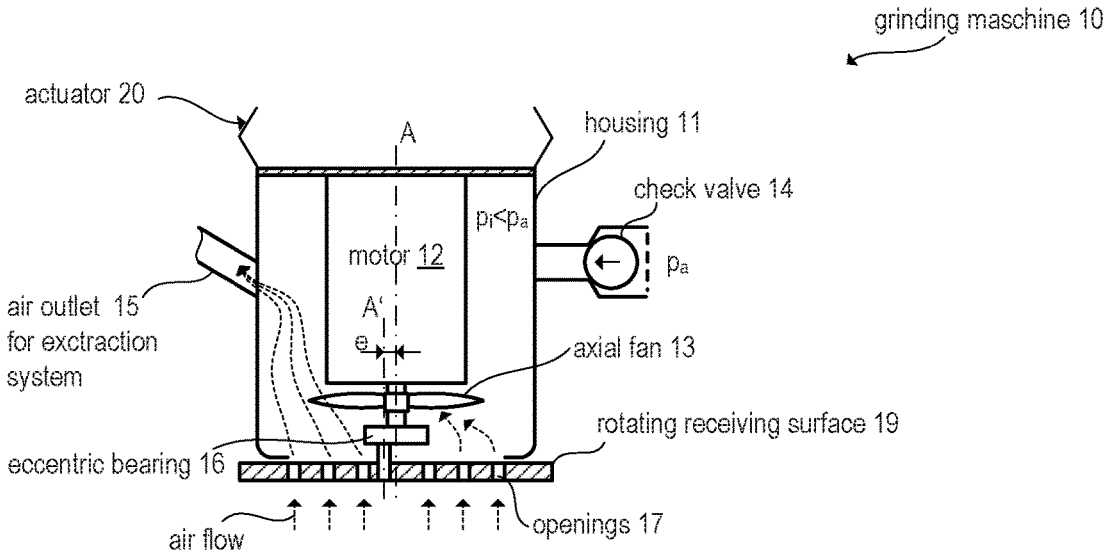
FIG. 2 shows a schematic example of an orbital grinding machine with combined air cooling and extraction.

FIG. 2 shows a schematic example of a grinding machine 10 with combined cooling and extraction. The grinding machine 10 may be mounted, as shown in FIG. 1, on a manipulator 1 in order to carry out a robot-supported grinding process. FIG. 2 is a schematic longitudinal view along a longitudinal axis A of the grinding machine 10 (this may coincide with the axis of segment 2*a*, cf. FIG. 1). The grinding machine 10 comprises a housing 11, which may be of an essentially cylindrical basic shape (whereas this need not necessarily be the case). An electromotor 12 is arranged in the interior of the housing 11. The axis of rotation of the motor shaft of the motor 12 also corresponds to the longitudinal axis A of the grinding machine 10. In the present example, the motor shaft is coupled, via an eccentric bearing 16, to a rotating receiving surface 19 (backing pad), to which a grinding disk is attached when in operation. For example, the grinding disk may be attached to the receiving surface by means of a hook-and-loop (Velcro) fastener. The eccentric bearing 16 allows for a rotation of the rotating receiving surface around an eccentric axis of rotation A' that rotates around the longitudinal axis A. The axial displacement between the motor shaft (axis of rotation A) and the eccentric shaft (axis of rotation A') is denoted as e in FIG. 2. The basic construction of the drive of the rotating receiving surface 19 is commonly known and will therefore not be discussed here further.

As stated, grinding machines, in particular orbital grinding machines, can be coupled to an extraction system for extracting grinding dust. The extraction system—similar to a vacuum cleaner—generates a vacuum and is coupled to the interior of the housing 11 via a hose. In the present example, the hose of the extraction system can be connected to the air outlet 15. During a grinding operation air is suctioned through the openings 17 into the interior of the housing 11, whereby grinding dust is transported into the interior of the housing, and then out through the air outlet 15. The flow of the air stream through the housing 11 is depicted by a dashed arrow in FIG. 2. The vacuum in the interior of the housing that is generated by the extraction system causes the check valve 14 shown in FIG. 2, which connects the interior of the housing 11 to the outside environment, to remain closed (the pressure $p_i$ in the interior is less than the environmental pressure $p_a$). In the illustrated situation in which the extraction system is active and the check valve 14 is closed, the axial fan wheel 13 attached to the motor shaft is actually redundant and serves to strengthen the air stream generated by the extraction system.

The air stream generated by the extraction system simultaneously cools the interior of the housing while transferring heat from the motor 12 and the eccentric bearing 16. Due to the compact construction design of the grinding machine, this cooling is needed to keep it from overheating. Without such cooling, temperatures of over 150° can result in damage to the motor or the mechanical components. When in operation, however, the danger exists that the extraction system, for one reason or another, might not function properly, for example, if an operator forgets to turn on the extraction system or because an air hose has come loose, etc. This generally does not present a problem with conventional grinding machines because, on the one hand, thanks to their less compact construction design, less waste heat is produced and, on the other hand, extraction and cooling are two mutually independent subsystems. The grinding machine construction design described here, however, with combined cooling and extraction, depends on a functioning extraction system if no additional measures have been provided to prevent the grinding machine from overheating when the extraction system is not working. If the extraction system fails, the axial wheel fan 13 is not always capable of generating sufficient heat convection, in particular if the resistance against the air stream flowing through the air outlet 15 is too high. This may be the case, e.g. if the extraction system is connected to the air outlet 15 via a hose but the extraction system has been turned off or fails.

Figure 3:
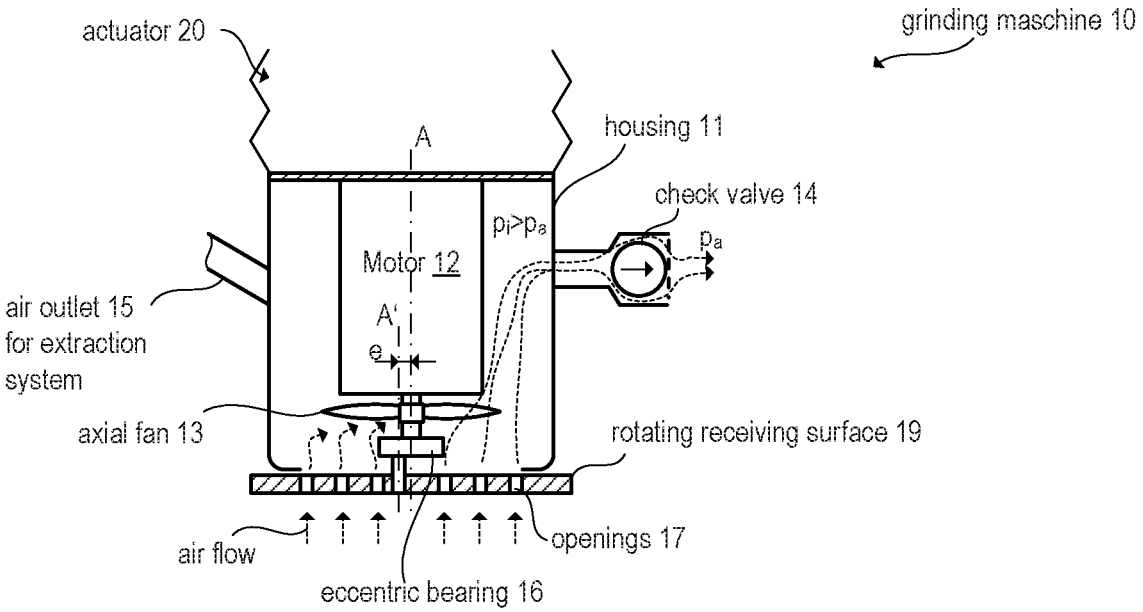
FIG. 3 shows the example of FIG. 2 in a situation in which the extraction system is inactive.

FIG. 3 shows the example from FIG. 2 in a situation in which the extraction system is inactive. In order to prevent the grinding machine 10 from overheating despite this situation, an axial fan (wheel fan, propeller), which under normal operating conditions with functioning extraction would normally be redundant, is arranged on the motor shaft of the motor 12 and can generate an air stream through the interior of the housing for cooling purposes. As shown in FIG. 3, the axial wheel fan also suctions in air through the openings 17 and generates an air stream to cool the interior of the housing 11. As mentioned above, situations may arise in which it cannot be ensured that the air stream generated by the axial wheel fan 13 will be able to be exhausted through the outlet 15. If, for example, a hose is also connected to the outlet 15, the air resistance in the hose may be so great that the axial wheel fan 13 will not be able to generate enough volume flow to sufficiently cool the interior of the housing. For this reason, the grinding machine illustrated in FIGS. 2 and 3 has a check valve 14 that allows air from the interior of the housing 11 to be released into the environment. When the extraction system is inactive, the axial wheel fan generates an inner air pressure $p_i$ (stagnation pressure) in the housing that is greater than the environmental air pressure $p_a$. As a result of this, the check valve opens and air can escape from the housing via the check valve, meeting relatively little air resistance and, in the process, transferring away heat. In the case of machines that do not have a separate cooling system (independent of the extraction system), the axial wheel fan 13—in combination with the check valve 14—is therefore a safety feature that prevents the motor from overheating when the extraction system does not generate sufficient air stream to cool the motor. The axial wheel fan may be (but is not necessarily) the only fan in the housing 11. Here it should be pointedly reiterated that, under "normal" operating conditions when the extraction system is active, the latter generates the air stream that cools the motor.

Figure 4:
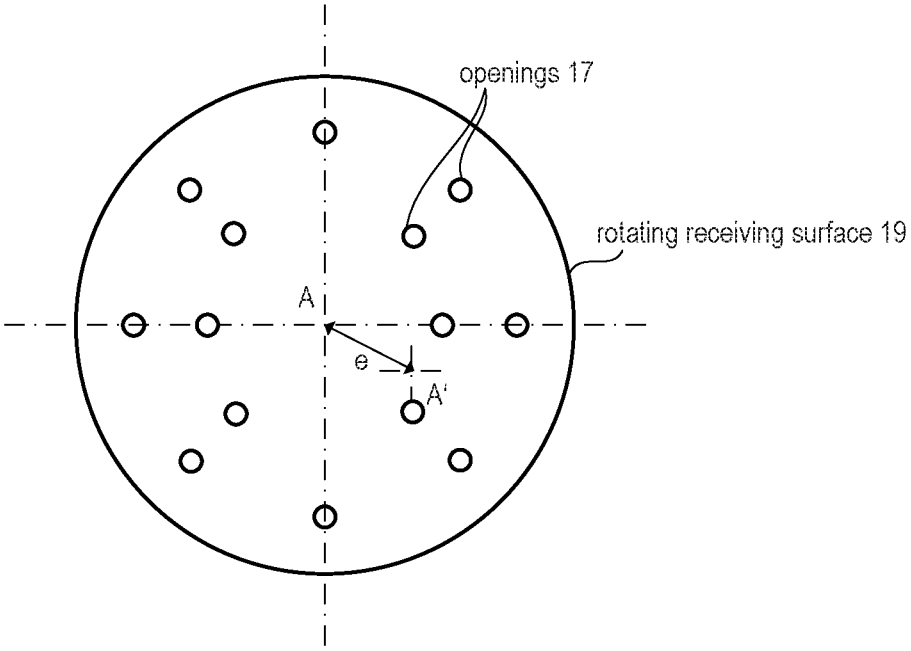
FIG. 4 shows, in a view from below, the rotating receiving surface (backing pad) with openings as in FIG. 2.

FIG. 4 shows the rotating receiving surface 19 (backing pad) with the openings 17 in a view from below. As mentioned earlier on, the surface of the receiving surface 19 may be adhesive (e.g. provided with a hook-and-loop fastener) in order that a grinding disc may be attached to it. In FIG. 4 the axis of rotation 4 of the motor shaft and the eccentric axis of rotation A' of the receiving surface 19 are also shown. Here it should be noted that the embodiments described here are not restricted orbital grinding machines. The combined cooling and extraction system described with regard to FIGS. 2 and 3 may also be utilized with other grinding machines that have a rotating grinding tool (grinding disc), also when the grinding tool carries out a purely rotational movement instead of an orbital movement.

At mentioned at the beginning, a compact and light construction design of the grinding machine can help to reduce inertia forces and improve the control of the contact force. A further aspect to be considered when controlling the contact force is the role played by disturbing forces caused by the bending of cables and hoses. These disturbing forces act parallel to the actuator 20 (between grinding machine 10 and TCP of the manipulator 1) and therefore cannot be easily compensated by the actuator. FIGS. 5A and 5B show an example cable routing on a robot-supported grinding apparatus with a grinding machine 10 and an actuator 20, wherein the cables (electric wires) needed to operate the grinding machine are wound around the longitudinal axis A in a roughly spiral formed curve. FIG. 5A is a schematic front view and FIG. 5B is a schematic view from below.

Routing the cable(s) 18 in a roughly spiral formed curve (at least partially) around the grinding machine 10 and the actuator 20 has the effect that a change in the deflection a of the actuator 20 results in a minimal change to the deflection of the cable(s) 18. Furthermore, thanks to the spiral formed cable routing, the disturbing forces along the longitudinal axis A (i.e. in the effective direction of the actuator) are, in general, reduced to a minimum. In comparison, when the cable(s) are routed in a conventional manner, that is, when the cable(s) 18 are wrapped into a loop on the side of the actuator 20, the resulting disturbing forces are much stronger and vary much more widely in strength.

The hose (not shown) that is connected to the outlet 15 (see FIG. 3) and through which the grinding dust is extracted can be routed in a spiral-formed curve in the same way as the cable(s) 18. Numerous cables 18 can be routed together in a cable tube. As shown in FIG. 5, an end of the cable 18 is connected to the grinding machine 10 (and is routed through the wall of the housing 11), whereas the other end of the cable 18 is mechanically connected to the outmost segment 2*a* of the manipulator 1.

In the following, some important aspects of the embodiments described here will be summarized. What follows, however, is not to be understood as a complete list, but only as an exemplary list. One embodiment is directed to a grinding machine 10 that is suitable for use in a robot-supported grinding process (cf. FIG. 2). The grinding machine comprises a housing 11, a motor 12 arranged in the interior of the housing, a wheel fan 13 arranged on a motor shaft of the motor in the interior of the housing and a rotating receiving surface 19 (backing pad) for receiving a grinding disk coupled to the motor shaft 12. The backing pad has openings 17 through which grinding dust is suctioned into the interior of the housing 11. The grinding machine 10 also has an outlet 15 arranged in a wall of the housing for suctioning the grinding dust out of the interior of the housing and a check valve 14 arranged in a wall of the housing 11. The check valve 14 allows air to escape from the interior of the housing, prevents, however, air from being suctioned into the interior of the housing (cf. FIGS. 2 and 3).

In another embodiment, the motor 12 is arranged in the interior of the housing 11 such that the air stream that flows from the openings 17 in the backing pad 19 and on to the outlet, and with which the grinding dust is extracted, also cools the motor 12. The air stream generated for the dust extraction is thus also used to cool the motor. In the case of an orbital grinder, the grinding machine has an eccentric bearing 16 that connects the motor shaft to the backing pad 19, enabling the backing pad 19 to carry out an orbital movement. The aforementioned air stream that flows from the openings 17 in the backing pad 19 and on to the outlet, and with which the grinding dust is extracted, also cools the eccentric bearing 16.

If suction through the outlet 15 is absent, air suctioned in through the openings 17 in the backing pad 19 by the wheel fan 13 is released through the check valve 14 (see FIG. 3). In other words, the wheel fan 13 generates a stagnation pressure in the interior of the housing 11, forcing air from the interior of the housing 11, through the check valve and out into the environment.

In order to reduce the disturbing forces that arise due to the cable(s) and hose(s) connected to the grinding machine, a cable 18 for supplying electrical energy to the motor 12 can be wrapped around the housing 11 in a roughly spiral-formed curve.

A further aspect regards an apparatus for robot-supported grinding comprising a manipulator 1 (e.g. an industrial robot), a grinding machine 10 in accordance with the examples described here, a linear actuator 20 that couples the grinding machine 10 to a TCP of the manipulator 1 and an extraction system connected to an outlet in the housing of the grinding machine (cf. FIGS. 1 and 2). A further aspect regards a method for cooling a grinding machine 10 that has a rotating backing pad 19 for receiving a grinding disc. The method comprises generating a vacuum in the interior of the housing 11 of the grinding machine 10 using an extraction system that is connected to the interior of the housing via an air outlet 15 in a wall of the housing (see FIGS. 2 and 3). In the process, the vacuum creates an air stream that flows through the openings 17 in the backing pad 19 and that transports grinding dust into the interior of the housing 11. The grinding dust is then suctioned off through the outlet 15 in the housing wall. At the same time, a motor arranged in the interior of the housing is cooled by the air stream. For cases in which the extraction system is inactive, the method provides for the generation of a further air stream for cooling the motor 12 that flows through the openings 17 in the backing pad 19 by means of a wheel fan 13 that creates a stagnation pressure in the interior of the housing 11, causing a check valve 14 in the housing wall to open and to release the further air stream.

Although various embodiments have been illustrated and described with respect to one or more specific implementations, alterations and/or modifications may be made to the illustrated examples without departing from the spirit and scope of the appended claims. With particular regard to the various functions performed by the above described components or structures (units, assemblies, devices, circuits, systems, etc.), the terms (including a reference to a "means") used to describe such components are intended to correspond—unless otherwise indicated—to any component or structure that performs the specified function of the described component (e.g., that is functionally equivalent), even if it is not structurally equivalent to the disclosed structure that performs the function in the herein illustrated exemplary implementations of the invention.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

The invention claimed is:

1. A grinding machine, comprising:

a housing;

a motor arranged in an interior of the housing;

a wheel fan arranged on a motor shaft of the motor in the interior of the housing;

a backing pad coupled to the motor shaft, the backing pad configured to receive a grinding disc and having openings for suctioning grinding dust into the interior of the housing;

an outlet arranged in a wall of the housing and configured to suction the grinding dust out of the interior of the housing, the outlet being connectable to an extraction system configured to generate a vacuum in the interior of the housing of the grinding machine; and a check valve arranged in the wall of the housing and configured to allow air to escape from the interior of the housing and to prevent air from being suctioned into the interior of the housing.

2. The grinding machine of claim 1, wherein the motor is arranged in the interior of the housing such that the motor is cooled by an air stream that flows from the openings in the backing pad and on to the outlet and with which the grinding dust is extracted.

3. The grinding machine of claim 1, further comprising:

an eccentric bearing connecting the motor shaft to the backing pad such that the backing pad can carry out an orbital movement, wherein the motor is cooled by an air stream that flows from the openings in the backing pad and on to the outlet and with which the grinding dust is extracted.

4. The grinding machine of claim 1, wherein if extraction is absent, air suctioned in through the openings in the backing pad by means of the wheel fan escapes through the check valve.

5. The grinding machine of claim 1, wherein when the wheel fan generates a stagnation pressure in the interior of the housing, air can escape from the interior of the housing and into the environment through the check valve.

6. The grinding machine of claim 1, further comprising:

a cable for supplying electricity to the motor, the cable being wrapped in a roughly spiral-formed curve around the housing.

7. A method for cooling a grinding machine that has a rotating backing pad for receiving a grinding disc, the method comprising:

generating a vacuum in an interior of a housing of the grinding machine by an extraction system connected to the interior of the housing via an air outlet in a housing wall, wherein due to the vacuum, an air stream is caused to flow through openings in the backing pad which transports grinding dust into the interior of the housing that is suctioned off via the outlet in the housing wall, wherein a motor arranged in the interior of the housing is also cooled by the air stream; and when the extraction system is inactive, generating a further air stream for cooling the motor through the openings in the backing pad by means of a wheel fan that generates a stagnation pressure on the interior of the housing so that a check valve arranged in the housing wall opens and the further air stream can escape.

8. The method of claim 7, wherein the wheel fan is attached to the motor shaft of the motor and comprises an axial fan.

9. The method of claim 7, wherein the check valve is closed when the extraction system is active.

10. An apparatus for robot-supported grinding, comprising:

a manipulator;

a grinding machine comprising a housing, a motor arranged in an interior of the housing, a wheel fan arranged on a motor shaft of the motor in the interior of the housing, a backing pad coupled to the motor shaft, the backing pad configured to receive a grinding disc and having openings for suctioning grinding dust into the interior of the housing, an outlet arranged in a wall of the housing and configured to suction the grinding dust out of the interior of the housing, the outlet being connectable to an extraction system configured to generate a vacuum in the interior of the housing of the grinding machine, and a check valve arranged in the wall of the housing and configured to allow air to escape from the interior of the housing and to prevent air from being suctioned into the interior of the housing;

a linear actuator coupling the grinding machine to a tool center point (TCP) of the manipulator; and an extraction system connected to the outlet in the housing of the grinding machine.

11. The apparatus of claim 10, wherein an effective direction of the linear actuator runs essentially parallel to an axis of rotation of the motor.

12. The apparatus of claim 10, wherein a cable for operating the grinding machine is arranged in a roughly spiral-formed curve around a longitudinal axis of the housing of the grinding machine and the linear actuator, and wherein the cable is mechanically coupled to the manipulator.

13. The apparatus of claim 12, wherein the cable is arranged together with other cables in a cable hose.

14. The grinding machine of claim 1, wherein the check valve is arranged separate from the outlet in the wall of the housing.

15. The grinding machine of claim 1, wherein the check valve is configured to close due to the vacuum generated by the extraction system when the extraction system is active, and wherein the check valve is configured to open due to air flow caused by the wheel fan when the extraction system is inactive.

16. The apparatus of claim 10, wherein the check valve is arranged separate from the outlet in the wall of the housing.

17. The apparatus of claim 10, wherein the check valve is configured to close due to the vacuum generated by the extraction system when the extraction system is active, and wherein the check valve is configured to open due to air flow caused by the wheel fan when the extraction system is inactive.

* * * * *